US006163996A

United States Patent [19]

Gebka

[11] Patent Number: 6,163,996

[45] Date of Patent: Dec. 26, 2000

[54] SIGN HOLDER

[75] Inventor: John Gebka, Coral Springs, Fla.

[73] Assignee: Fast Industries, Ltd., Fort Lauderdale, Fla.

[21] Appl. No.: 09/520,167

[22] Filed: Mar. 7, 2000

[51] Int. Cl.[7] ..... G09F 3/18

[52] U.S. Cl. ..... 40/661.03; 40/661; 40/661.08

[58] Field of Search ..... 40/661.03, 661.02, 40/661.08, 661

[56] References Cited

U.S. PATENT DOCUMENTS

| | | |
|---|---|---|
| 4,483,502 | 11/1984 | Fast . |
| 4,485,575 | 12/1984 | Fast . |
| 4,531,313 | 7/1985 | Fast . |
| 4,704,813 | 11/1987 | Fast . |
| 4,716,669 | 1/1988 | Fast . |
| 4,995,182 | 2/1991 | Fast . |
| 5,488,793 | 2/1996 | Gebka et al. . |
| 5,682,698 | 11/1997 | Bevins . |

*Primary Examiner*—Cassandra H. Davis
*Attorney, Agent, or Firm*—Jacobson, Price, Holman & Stern, PLLC

[57] ABSTRACT

A transparent sheet material sign holder having upper and lower reverted flaps to slidably receive a paper, cardboard or plastic sign behind a transparent main body panel. The upper flap is adapted for engagement between the upper and lower lips of a C-channel on the front of a merchandise shelf. Independent portions of the upper flap are of a reduced height so as to retain the upper edge portions of the sign in the event the sign holder is flexed forwardly at its bottom edge. The C-channel-engaging flap portions can be centrally located, with independent side portions of a smaller height. Alternatively, the sign-retaining portions of a smaller height can be simply defined by a U-shaped cut in the upper flap. Similar sign-retaining portions can be provided on upper and lower flaps of different dimensions so that the sign holder can be inverted for engagement in C-channel of different heights while independently retaining a sign in the sign holder.

13 Claims, 5 Drawing Sheets

SIGN HOLDER

BACKGROUND OF THE INVENTION

This invention relates to a sign holder for use with merchandise display shelves of the type in which the shelves have C-channels formed along the front edge. Shelves with C-channels are commonly found in merchandise outlets such as supermarkets and the like, the C-channel being formed with upper and lower lips, form a convenient means for mounting many different kinds of fit-in articles such as labels, signs or sign holders which provide information relating to merchandise displayed on a shelf.

One criterion which is applicable to the design of articles such as signs and sign holders adapted to be fitted into a C-channel is the size, particularly the height, of the channel itself between the pocket formed by the downwardly opening upper lip and the pocket formed by the upwardly opening lower lip, since variations in channel height can affect the fit of an article in the channel. There may, for example, be small variations in height between different C-channels having nominally the same dimensions or, alternatively, different shelves may have different size C-channels. Accordingly, variations in C-channel dimensions need be taken into account in the design of fit-in sign holders and the like.

In Bevins U.S. Pat. No. 5,682,698 issued Nov. 4, 1997, a sign holder which can be used on shelves having C-channels of somewhat differing heights is disclosed. The Bevins product comprises a sheet of plastic forming a transparent main body panel with backwardly folded flaps or flanges of differing heights at its top and bottom edges, the heights of the flaps corresponding to the heights of two different C-channels. In use, one or the other of the flaps is fitted in an appropriate C-channel with the bight formed at the connection between the backwardly folded upper flap and the body portion engaged in the upper lip of the C-channel, and the freely extending lower edge portions of the upper flap engaged in the lower lip of the C-channel. A sign or card of suitable dimensions can be fitted between the flaps against the back face of the holder with a major portion of the sign holder depending well below the C-channel.

With the Bevins' construction, the sign holder and the sign can be reversed, with the other flap engaged in a C-channel of a corresponding height in a different shelf While the Bevins' sign holder provides advantages not found in products of a similar nature previously available, one problem with the Bevins' design is that, regardless of which flap is used to secure the sign holder to the C-channel, that flap provides only limited assistance in securing the sign within the sign holder. The majority of the sign-holding capacity of the Bevins' sign holder is afforded by the lowermost flap and the front face of the shelf or price channel. With such a construction, there is a tendency for the sign to become dislodged from the sign holder if the depending portions of the sign holder are flexed forwardly as may occur when a customer reaches for a product on a lower shelf In that event, the top edge of the sign may free itself from contact with the shelf or price channel and any engagement with the upper flap of the sign holder, sometimes permitting the sign to be totally disengaged from the sign holder.

The accidental disengagement of the sign is an obvious problem for the merchandiser who no longer presents information regarding the products on the shelf to the consumer. Not only can there be lost sales from the lack of appropriate information regarding the products, but the failure to provide appropriate pricing information can result in fines from governmental agencies.

Additionally, since such signs commonly carry a barcode for inventory control, the loss of a sign diminishes the effect of this system.

Finally, the loss of a sign from its holder by accidental engagement with the sign holder can produce a major insurance risk from a customer slipping on the loose sign sliding underfoot.

SUMMARY OF THE INVENTION

It is, therefore, a primary object of the instant invention to provide a sign holder of simple and economical manufacture which may be secured in C-channels formed along the front edge of merchandise shelves wherein the flap that is used to attach the sign holder to the C-channel includes independent portions which secure the sign to the sign holder, even if the sign holder is flexed forwardly at its lower edge.

Another object of this invention is the provision of a sign holder of the type described wherein flaps of different height enable the sign holder to be used on C-channels of different shelves, much like the Bevins' product, but wherein each flap incorporates means to secure the sign to the sign holder with other portions securing the sign holder to the C-channel.

A further object of this invention is the provision of a sign holder having an upper backwardly folded flap divided into at least two portions, one portion of which is dimensioned to be fitted into a C-channel to secure the sign holder to the front of a shelf, with other portions of a reduced height securing the upper edge of a sign within the sign holder, the sign-engaging portions being unaffected by twisting or flexing of the sign holder in use.

The foregoing objectives can be affected by dividing one or both of the sign holder flaps into a central section of a height corresponding to the distance between the lips of a C-channel in which the sign holder is to be secured. Portions on either side of the central section may then be of a height less than the C-channel-engaging central section so that they will retain the upper edges of a sign, regardless of the angle between the central section of the flap and the body panel resulting from pressure against the back of the dependent portions of the sign holder.

Alternatively, the upper flap may extend substantially the full width of the sign holder, with a smaller upper flap defined by a U-shaped cut-out so that the smaller flap will retain the sign without regard to any twisting action on the remainder of the upper flap which is engaged in the C-channel.

Other and further objects of the instant invention will become apparent from the ensuing description and claims read in conjunction with the attached drawings.

BRIEF DESCRIPTION OF THE DRAWINGS

Like reference characters refer to like parts throughout the several views of the drawings.

DETAILED DESCRIPTION OF THE PREFERRED EMBODIMENTS

Figure 2:
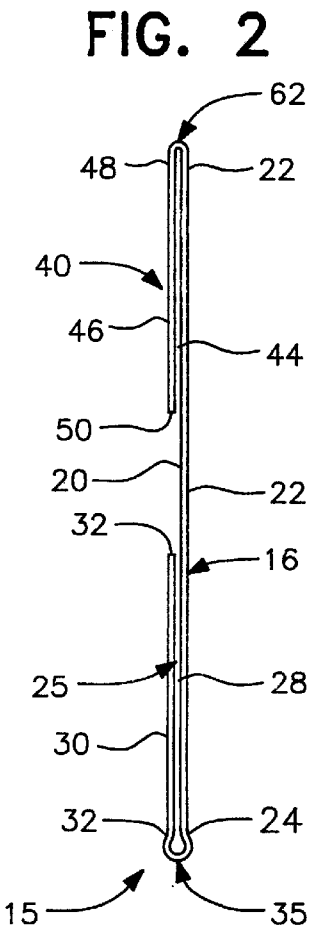
FIG. 2 is a side elevational view of the sign holder formed by the blank of FIG. 1.
Figure 1:
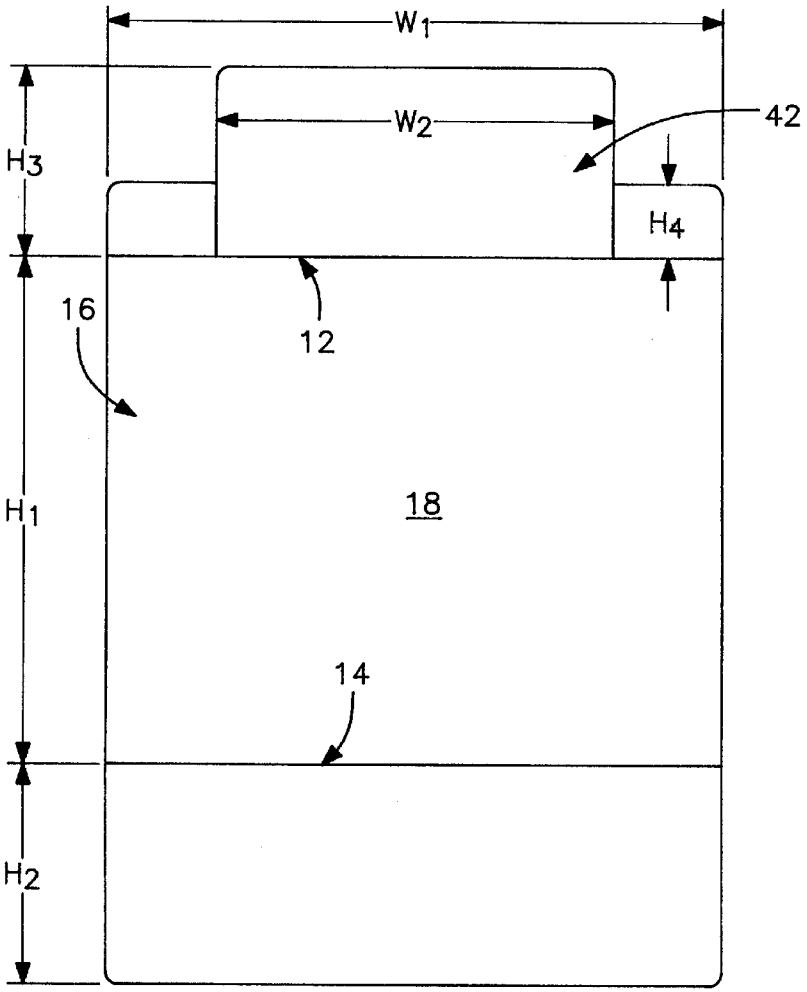
FIG. 1 is a top plan view of a blank for forming one embodiment of a sign holder according to the instant inventive concepts.
Figure 3:
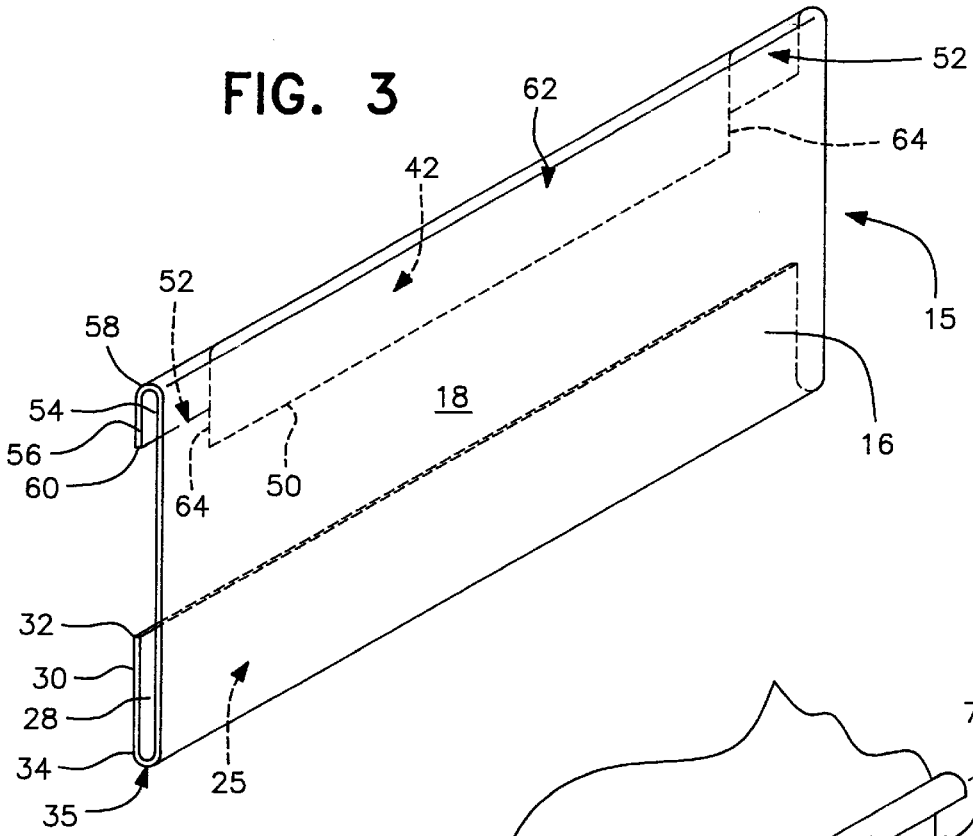
FIG. 3 is a perspective view of the first embodiment of sign holder according to this invention, hidden portions being shown in dotted lines.
Figure 4:
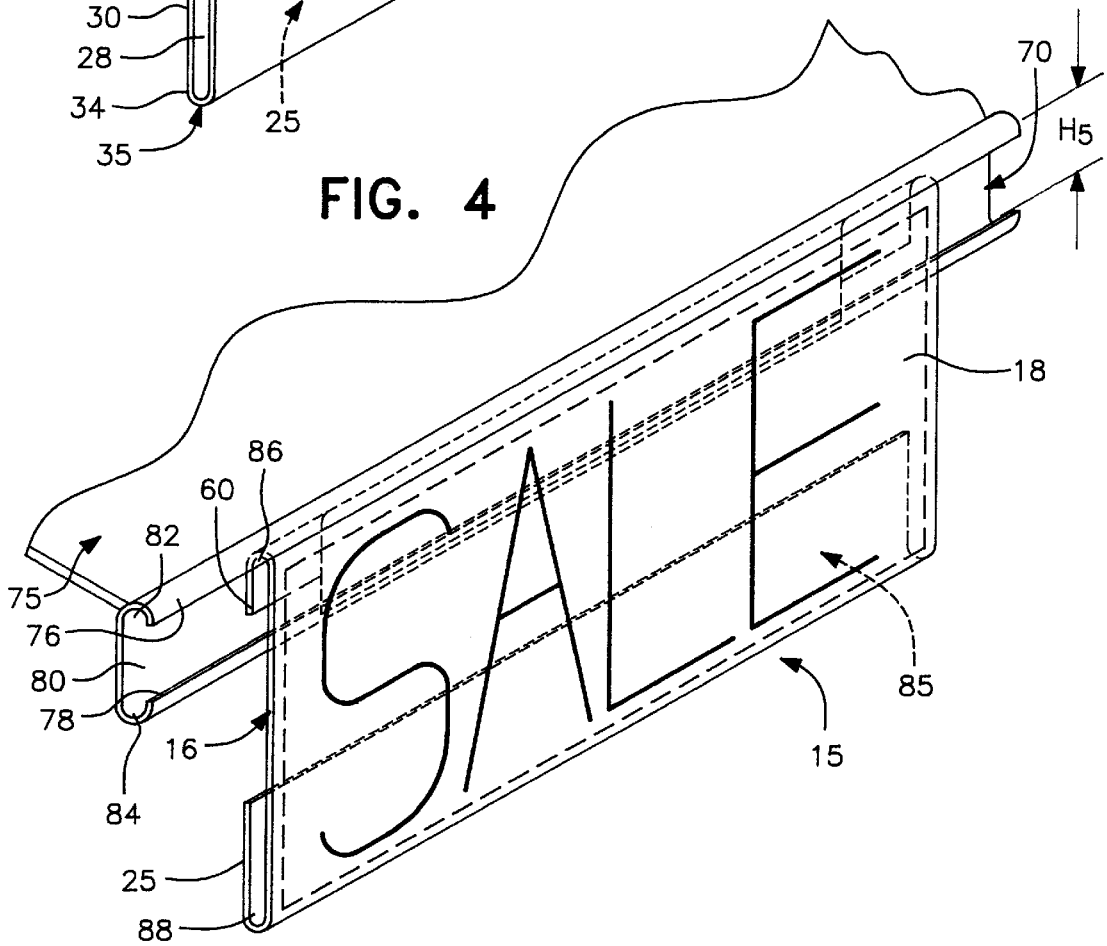
FIG. 4 is perspective a view of the sign holder of FIG. 3 mounted in a C-channel at the front of a merchandise display shelf, with a SALE sign inserted in the sign holder.

Referring first to FIG. 1, a blank for forming one embodiment of a sign holder according to the instant inventive concepts is designated generally by the reference numeral 10 and comprises a die-cut sheet of transparent plastic material. The blank 10 is heat-folded along lines 12, 14 as seen in FIGS. 2–4 to form a sign holder 15 comprising a transparent main body panel 16 having a front face 18, a back face 20, an upper edge 22 and a lower edge 24.

A lower flap 25 extends from the lower edge 24 of the body panel 16, behind, and in spaced, generally parallel, relation to the back face 20 of the body panel 16. The lower flap 25 includes a front face 28, a back face 30, an upper edge 32 and a lower edge 34. The lower edges 24 of the body panel 16 and 34 of the lower flap 25 are integrally connected by a resilient lower bight portion 35 formed at the fold lines 14.

An upper flap 40 extends from the upper edge 22 of the body panel 16 behind, and in spaced, generally parallel, relation to the back face 20 of the body panel 16. The upper flap 40 is divided into a first or central upper flap portion 42 having a front face 44, a back face 46, an upper edge 48 and a lower edge 50. Second or side upper flap portions 52, 52 extend on opposite sides of the first upper flap portion 42, each having a front face 54, a back face 56, an upper edge 58 and a lower edge 60.

The first upper flap portion 42 and the second upper flap portions 52, 52 are each integrally connected at their upper edges to the upper edge 22 of the body panel 16 by continuous resilient bight portions 62. The sides 64 of the first upper flap portion 42 are cut all the way through to the bight portions 62 so that the first upper flap 42 can move independently of the side flaps 52.

The distance between fold lines 12 and 14 defines the height $H_1$ of the body panel 62; the distance between the fold line 14 and the upper edge 32 of the lower flap 25 defines the height $H_2$ of the lower flap 25; the distance between the fold line 12 and the lower edge 46 of the first upper flap 42 defines the height $H_3$ of the first upper flap 42; and the distance between the fold line 12 and the lower edges 60 of the side flaps 52 define the height $H_4$ of the side flaps 52.

The distance between the sides of the blank 10 define the width $W_1$ of the sign holder 10 and the distance between the sides 64 of the first upper flap 42 defines the width $W_2$ of the first upper flap 42.

Reference is now made particularly to FIG. 4, wherein a sign holder 15 as illustrated in FIGS. 2 and 3 and formed from the blank 10 of FIG. 1, is attached to a C-channel 70 on the front of a merchandise display shelf 75. The C-channel 70 has upper and lower lips 76, 78 interconnected by a generally concave central portion 80. The upper lip 76 defines a downwardly opening pocket 82 and the lower lip 78 defines an upwardly opening pocket 84. Such C-channels are well known in the merchandise display art and may be integrally formed with the merchandise shelf 75 or formed independently of the shelf 75 from any of a variety of materials, including plastic, and secured to a downwardly depending flange (not shown) on some merchandise shelves by adhesive or any other conventional means. The height $H_5$ between the pockets 82, 84 may vary from shelf to shelf.

In accordance with the embodiment of FIGS. 1–4, the height $H_5$ of the C-channel 70 corresponds generally to the height $H_3$ of the first upper flap portion 42 so that the first upper flap 42 may be securely fitted in the C-channel 70. More specifically, the bight portions 62 of the upper flap 40 are engaged within the upper sign holder-receiving channel or pocket 82 of the C-channel 70 and the free lower edge portions 50 of the first upper flap 42 are engaged in the lower sign holder-receiving channel or pocket 84 of the C-channel 70. With the first upper flap 42 fitted in the C-channel 70, a major portion of the sign holder 15 depends below the C-channel 70 as seen in FIG. 4.

A sign, shown in dotted lines at 85 as bearing the message SALE, in the nature of a paper, cardboard or plastic card has its upper and lower edge portions 86, 88, respectively, engaged between the portions of the upper bight 62 connecting the second or side upper flaps 52 to the body panel 16, and the lower bight portions 35 of the lower flap 25 of the sign holder 15 in a removable manner. Because the height $H_4$ of the second upper flap portions 52, 52 less than the height $H_3$ of the first upper flap portion 42, the first upper flap portion 42 can be moved about its portions of the upper bight 62 independently of the second upper flaps 52, 52. Thus, should the sign holder 15 be flexed forwardly by accidentally pushing on its lower portions from behind, the first upper flap 42 retains its engagement within the pockets 82, 84 of the C-channel 70 and the second upper flaps 52, 52 retain the upper edge portions 86 of the sign 85 to preclude disengagement of the sign 85 from the sign holder 15 as might result if the upper flap was continuous and functioned both as the means to secure the sign holder 15 to the C-channel 70 and the sole means to retain the upper portion of the sign 85 within the sign holder 15 as in the aforementioned Bevins' patent.

Figure 5:
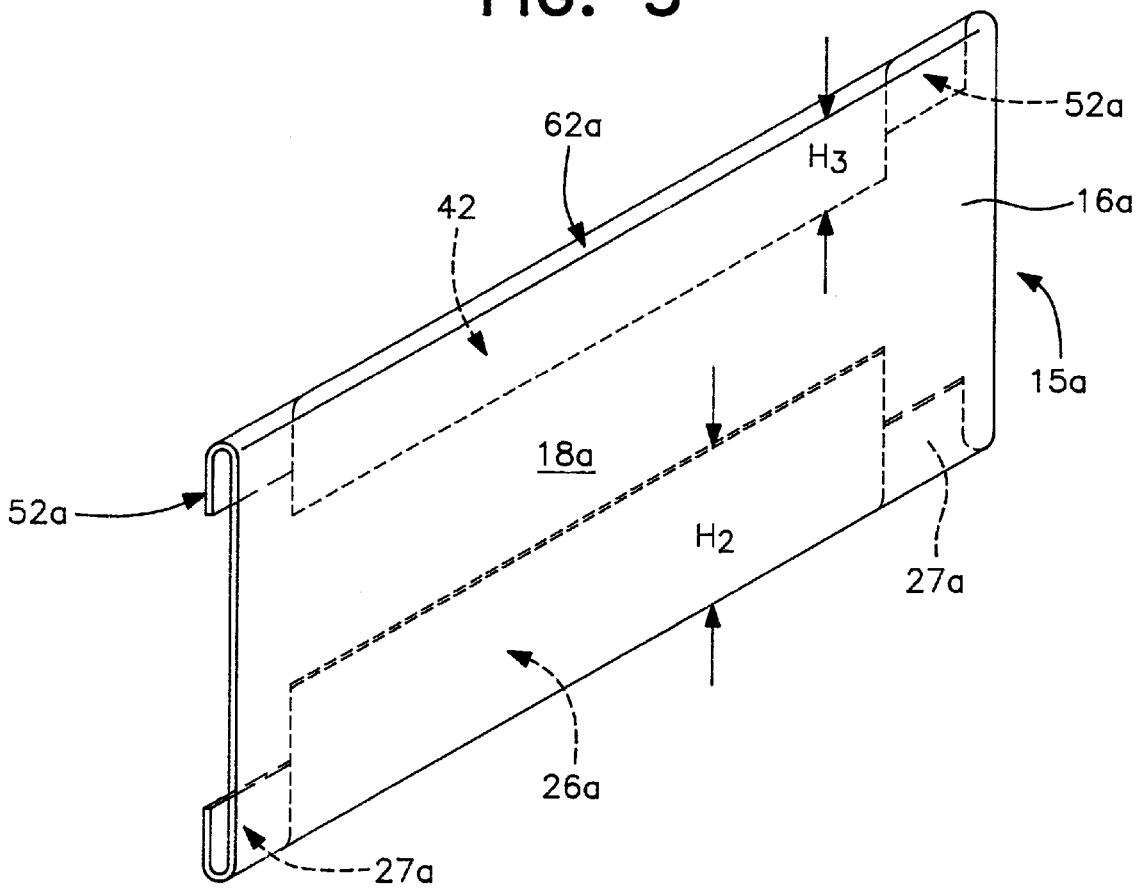
FIG. 5 is a view similar to FIG. 3, but with the upper and lower flaps being of different dimensions, each of which is provided with means to engage the same in a C-channel while securely retaining a sign within the sign holder according to this invention even if the sign holder is inverted in use.
Figure 7:
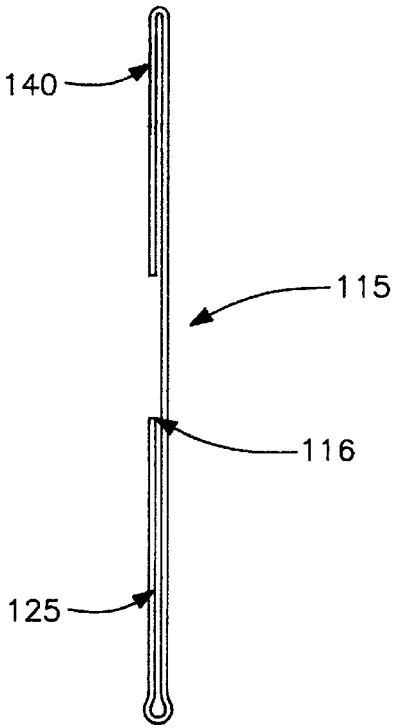
FIG. 7 is a side elevational view of a sign holder formed from the blank of FIG. 6.
Figure 6:
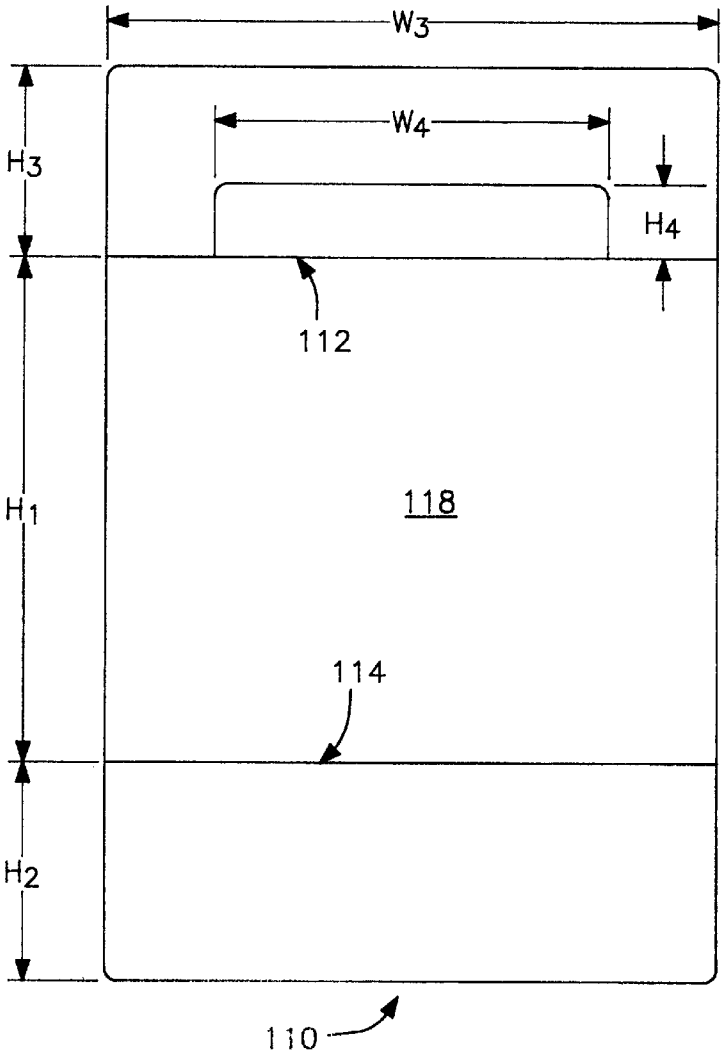
FIG. 6 is a top plan view of a blank for forming a sign holder according to yet another embodiment of the instant inventive concepts.
Figure 8:
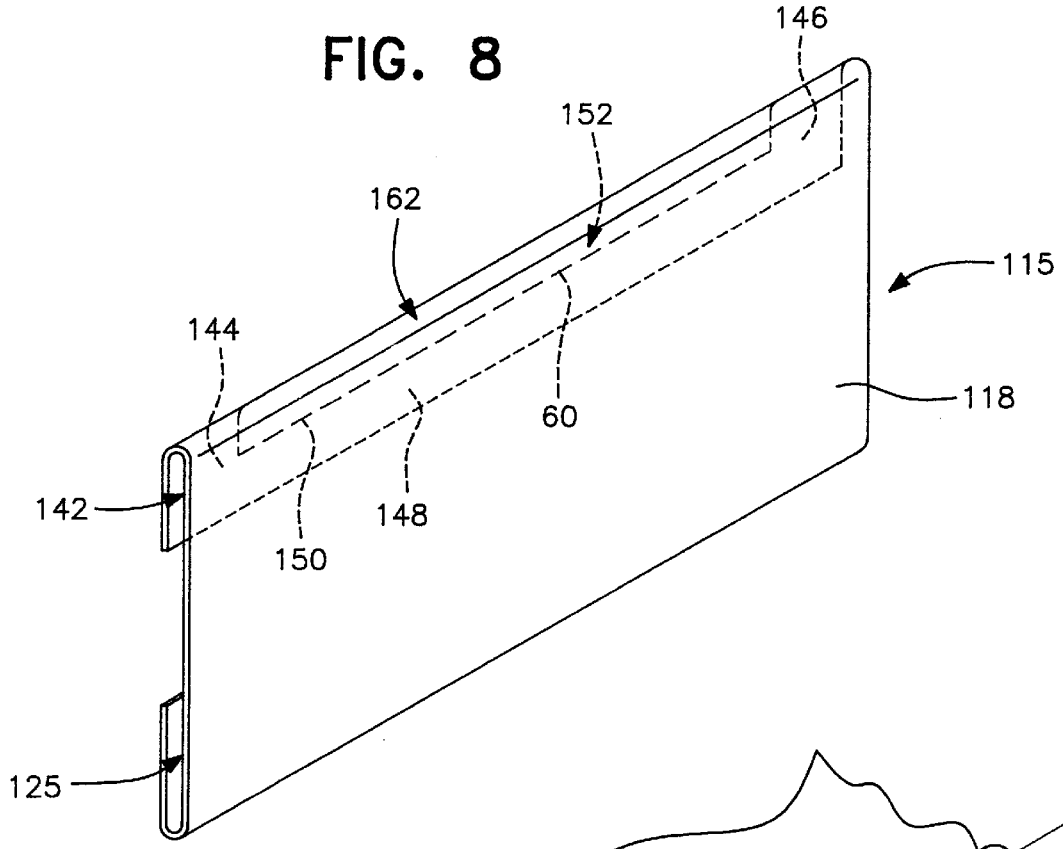
FIG. 8 is a perspective view thereof.
Figure 9:
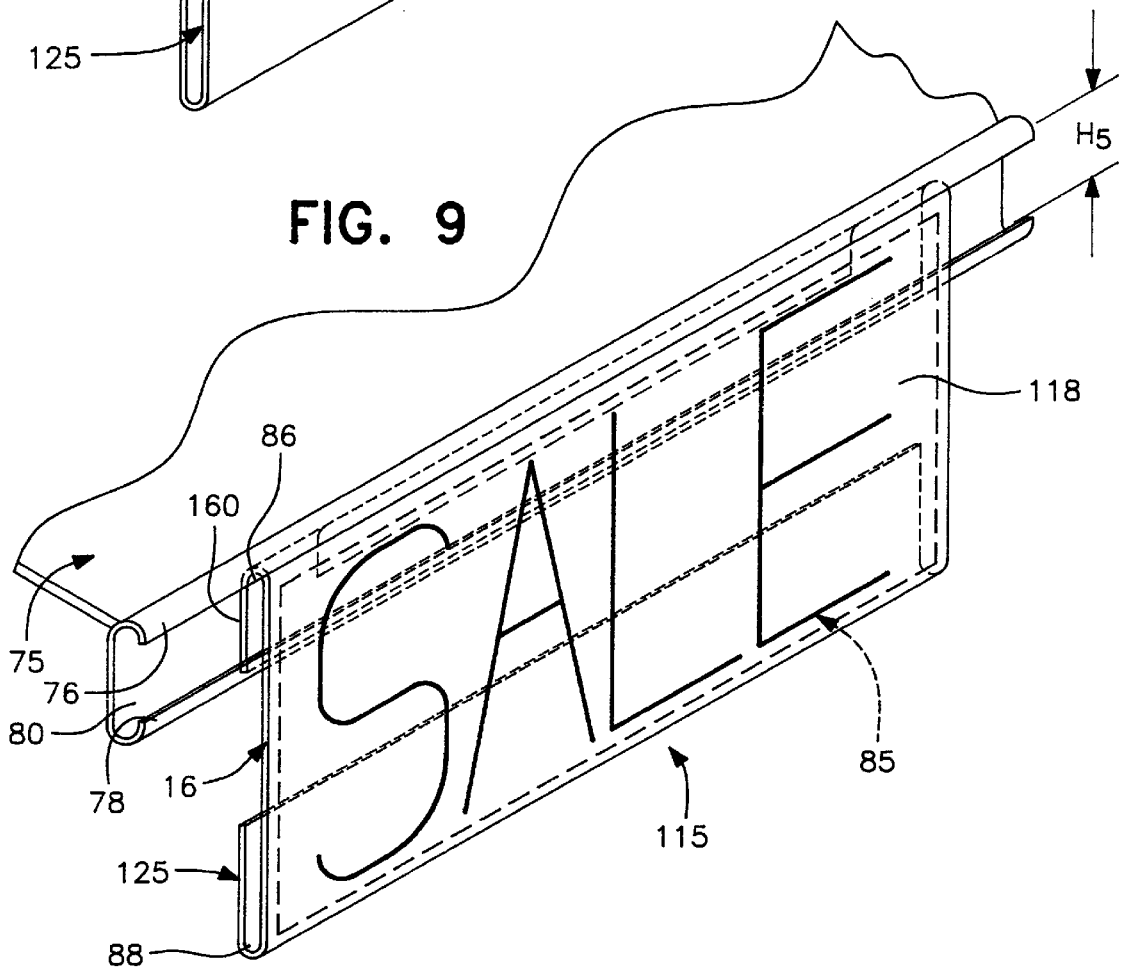
FIG. 9 is a perspective view of the sign holder of FIG. 8 mounted in a C-channel.

As indicated previously, the height $H_5$ of the C-channels on various merchandise shelves can vary to a significant extent. In order to avoid the need for retaining an inventory of sign holders having a first upper flap dimensioned to be fitted between the upper and lower lips of individual C-channels without losing the effectiveness of the sign-retaining means of the instant inventive concepts, the upper and lower flaps of a sign holder can each be provided with a first flap portion of a height adapted to be fitted into C-channels of differing dimensions, with each upper flap including other portions of lesser height adapted to securely engage and retain a sign, even if the sign holder is flexed forwardly in use. Such an embodiment is seen in FIG. 5 wherein parts similar to the embodiment of FIGS. 1–4 are designated by the same reference numeral followed by the suffix "a". For all intents and purposes, the body panel 16*a* and the first and second upper flaps 42*a* and 52*a* of the embodiment of FIG. 5 are identical to the body panel 16 and the first and second upper flaps 42, 52 of the embodiment of FIGS. 1–4. However, the lower flap 25*a* shown in FIG. 5 is divided into a first lower flap portion 26*a* having a height $H_2$ different from the height $H_3$ of the first upper flap 42*a*, with side flap portions 27*a*, 27*a* having a height $H_4$ similar to the height $H_4$ of the upper side flaps 52*a*. In this manner, the sign holder 15*a* of FIG. 5 can be inverted for use in C-channels of two different heights, the orientation seen in FIG. 5 being adapted for use in a C-channel having a height corresponding to the height $H_3$ of the first upper flap portion 42*a*, with the sign holder 15*a* being inverted for use in a C-channel having a height corresponding to the height $H_2$ of the first lower flap portion 26*a*. In either arrangement, a sign (not shown) will be securely engaged between the side flap portions 52*a* and the side flap portions 27*a*.

Referring now to FIGS. 6–9, a second embodiment of a sign holder according to the instant inventive concepts is illustrated. In this embodiment, the blank 100 seen in FIG. 6 has a pair of fold lines 112, 114. When folded, the blank 110 forms a sign holder 115 comprising a main body panel 116, a lower flap 125 and an upper flap 140. The distinctions between this embodiment and the embodiment of FIGS. 1–4 appear primarily in the manner in which the upper flap 140 is provided with independent means to retain a sign within the sign holder 115, even if the sign holder is flexed forwardly as discussed previously.

In this instance, the upper flap 140 comprises a first upper flap portion 142 which is effectively U-shaped including a pair of side legs 144, 146 with a connecting leg 148 interconnecting the side legs 144, 146 in spaced relationship to central portions of the upper bight 162. A U-shaped cut 150 in the upper flap 140 forms an opening within which the second upper flap portion 152 remain connected to the main body panel 116 by the bight portions 162.

In this instance, the second upper flap portion 152 has a shortened height $H_4$ corresponding to the height of the second upper flaps 52, 52 in the embodiment of FIGS. 1–4, whereas the U-shaped first upper flap 142 has a height $H_3$ corresponding to the height of the first upper flap 42 of the earlier embodiment and the height of a C-channel in which the sign holder 115 it is to be fitted. Here, the width $W_3$ of the sign holder 115 and the first upper flap 140 is greater than the width $W_4$ of the second upper flap 152, in effect inverting the relationship of the central C-channel-engaging flap portion 42 and the side sign-engaging flap portions 52, 52 of the first embodiment.

The use and operation of the second embodiment of the instant inventive concepts will be obvious from the foregoing and need not be explained in further detail.

Of course, the lower flap 125 of the embodiment of FIGS. 6–9 can also be provided with independent sign-engaging means similar to the upper flap in a manner such as seen in FIG. 5 with respect to the earlier embodiment so as to render the sign holder of the second embodiment invertible for use in C-channels of different heights. Additionally, one form of separate sign-retaining means may be used on one flap, while the other form of separate sign-retaining means is used on the other flap without departing from the instant inventive concepts.

While two embodiments of the instant invention have been illustrated in the drawings, it is to be understood that many variations on this theme may be obvious to those with ordinary skill in the art. For example, the C-channel-engaging flap portion, rather than being either centrally located as in the embodiment of FIGS. 1–5, or generally U-shaped, spanning the entire width of the sign holder as in the embodiment of FIGS. 6–9, could be entirely on one side of the upper flap, with a reduced height sign-retaining flap portion on the other side.

Other modifications of the basic concepts will be readily recognized, the key being the provision of first portions of the C-channel-engaging flap of a height corresponding to the C-channel, with second independent portions of a reduced height adapted to engage the upper portions of a sign and retain the same even if the sign holder is flexed forwardly about the engagement in the C-channel.

From the foregoing, it will be seen that the instant invention provides a simple and economical sign holder which can be securely engaged in a C-channel of a shelf, possibly even shelves of differing height, with means designed to retain a sign within the sign holder, notwithstanding the flexing of the sign holder about the flap fitted within the C-channel. Such a construction minimizes accidental dislodgment of a sign, maintaining the integrity of the information which is to be conveyed to the consumer and for inventory purposes, and avoiding the danger associated with freely moving signs dropping to the floor resulting in injury to a passerby.

While only preferred embodiments of the instant invention have been described herein in detail, the invention is not intended to be limited thereby and modifications can be made within the scope of the attached claims.

What is claimed is:

1. A sign holder formed of a transparent sheet material and adapted to fit in C-channels along front edges of merchandise display shelves, said sign holder comprising portions defining a transparent main body panel having a front face, a back face, an upper edge, and a lower edge, the distance between said upper and lower edges of said body panel defining the height of said body panel, a lower flap extending from said lower edge of said body panel, behind, and in spaced, generally parallel, relation to said back face of said body panel, said lower flap including a front face, a back face, an upper edge, and a lower edge, a resilient lower bight portion integrally connecting at least portions of said lower edges of said body panel and said lower flap, a first upper flap extending from limited portions of said upper edge of said body panel, behind and in spaced, generally parallel, relation to said back face of said body panel, said first upper flap having a front face, a back face, an upper edge and a lower edge, the distance between said upper and lower edges of said first upper flap defining the height of said first upper flap, a second upper flap extending from other limited portions of said upper edge of said body panel behind and in spaced, generally parallel, relation to said back face of said body panel, said second upper flap having a front face, a back face, an upper edge and a lower edge, the distance between said upper and lower edges of said second upper flap defining the height of said second upper flap, a first resilient upper bight portion integrally connecting said upper edge of said limited portions of said body panel with said upper edge of said first upper flap, a second resilient upper bight portion integrally connecting said upper edge of said other limited portions of said body panel with said upper edge of said second upper flap, said height of said first upper flap being greater than said height of said second upper flap and generally adapted to correspond to the height between upper and lower forwardly extending lips of C-channels with which the sign holder is to be used, whereby a sign may be removably carried between said lower bight portion and said second upper bight portion behind said back face of said main body panel, and said first upper flap may be engaged between the upper and lower lips of a C-channel of corresponding height.

2. A sign holder as claimed in claim 1 wherein the height of said lower flap and said first upper flap are different from each other and are adapted to correspond to the heights between upper and lower forwardly extending lips of different C-channels with which the sign holder is to be used, and said lower flap is divided into two segments of different height, wherein said sign holder may be inverted for use with such different C-channels.

3. A sign holder as claimed in claim 1 wherein said first upper flap is connected to central portions of said upper edge of said body panel, and said second upper flap is formed in two laterally spaced parts, one of said parts being connected to a side portion of said upper edge of said body panel on each side of said central portions.

4. A sign holder as claimed in claim 1 wherein said first upper flap is generally U-shaped including a pair of upwardly extending side legs each of which includes an upper edge connected to a side portion of said upper edge of said body panel with a connecting leg interconnecting said side legs in spaced relation to the central portions of said upper edge of said body panel to define therebetween an opening, said second upper flap being connected to said central portions of said upper edge of said body panel and extending within said opening.

5. A sign holder as claimed in claim 4 wherein said first upper flap extends the full width of said sign holder, and said second upper flap is formed by a U-shaped cut in said first upper flap.

6. A sign holder as claimed in claim 1 wherein said sheet material is plastic, and said bight portions interconnecting said body panel to said lower and upper flaps are defined by heat folds in the plastic.

7. In combination, a merchandise display shelf having an elongated front edge, a C-channel depending from said front edge of said shelf, said C-channel comprising a central section including a front face and upper and lower edges, an upper lip extending forwardly from said upper edge of said central section of said C-channel and defining, together with said front face of said central section of said C-channel, a downwardly opening, upper sign holder-receiving channel, and a lower lip extending forwardly from said lower edge of said central section of said C-channel and defining, together with said front face of said central section of said C-channel, an upwardly opening, lower sign holder-receiving channel, the distance between said upper and lower sign holder-receiving channels defining the height of said C-channel, and a sign holder, said sign holder being formed of a transparent sheet material and comprising portions defining a transparent main body panel having a front face, a back face, an upper edge, and a lower edge, the distance between said upper and lower edges of said body panel defining the height of said body panel, a lower flap extending from said lower edge of said body panel, behind, and in spaced, generally parallel, relation to said back face of said body panel, said lower flap including a front face, a back face, an upper edge, and a lower edge, a resilient lower bight portion integrally connecting at least portions of said lower edges of said body panel and said lower flap, a first upper flap extending from limited portions of said upper edge of said body panel, behind and in spaced, generally parallel, relation to said back face of said body panel, said first upper flap having a front face, a back face, an upper edge and a lower edge, the distance between said upper and lower edges of said first upper flap defining the height of said first upper flap, a second upper flap extending from other limited portions of said upper edge of said body panel behind and in spaced, generally parallel, relation to said back face of said body panel, said second upper flap having a front face, a back face, an upper edge and a lower edge, the distance between said upper and lower edges of said second upper flap defining the height of said second upper flap, a first resilient upper bight portion integrally connecting said upper edge of said limited portions of said body panel with said upper edge of said first upper flap, a second resilient upper bight portion integrally connecting said upper edge of said other limited portions of said body panel with said upper edge of said second upper flap, said height of said first upper flap being greater than said height of said second upper flap and said first upper flap having a height generally corresponding to said height of said C-channel, the bight portions at the upper edge of said upper flaps being engaged within said upper sign holder-receiving channel of said C-channel, and said first upper flap having free lower edge portions engaged within said lower sign holder-receiving channel of said C-channel.

8. A combination as claimed in claim 7 wherein said sheet material is plastic, and said bight portions interconnecting said body panel to said lower and upper flaps are defined by heat folds in the plastic.

9. A combination as claimed in claim 8, further including a sign having upper and lower edges received behind said face panel of said sign holder with said upper and lower edges of said sign engaged between said second upper bight portions and said lower bight portions of said sign holder.

10. A combination as claimed in claim 7 wherein the height of said lower flap and said first upper flap are different from each other and correspond to the heights between upper and lower forwardly extending lips of different C-channels with which the sign holder is to be used, and said lower flap is divided into two segments of different height, wherein said sign holder may be inverted for use with such different C-channels.

11. A combination as claimed in claim 7 wherein said first upper flap is connected to central portions of said upper edge of said body panel, and said second upper flap is formed in two laterally spaced parts, one of said parts being connected to a side portion of said upper edge of said body panel on each side of said central portions.

12. A combination as claimed in claim 7 wherein said first upper flap is generally U-shaped including a pair of upwardly extending side legs each of which includes an upper edge connected to a side portion of said upper edge of said body panel with a connecting leg interconnecting said side legs in spaced relation to the central portions of said upper edge of said body panel to define therebetween an opening, said second upper flap being connected to said central portions of said upper edge of said body panel and extending within said opening.

13. A combination as claimed in claim 12 wherein said first upper flap extends the full width of said sign holder, and said second upper flap is formed by a U-shaped cut in said first upper flap.

* * * * *